United States Patent [19]

Lipari

[11] 4,428,092

[45] Jan. 31, 1984

[54] ELECTRICAL TERMINAL PIN CONDITIONING APPARATUS

[75] Inventor: Dominic T. Lipari, Franklin, Ohio

[73] Assignee: Bell Telephone Laboratories, Incorporated, Murray Hill, N.J.

[21] Appl. No.: 353,082

[22] Filed: Mar. 1, 1982

[51] Int. Cl.[3] ..... B08B 1/00

[52] U.S. Cl. ..... 15/246; 15/104.94; 15/210 R

[58] Field of Search ..... 15/104.04, 104.92, 104.94, 15/104.93, 210 R, 210 B, 218.1, 244 R, 97 R, 246; 401/9, 10

[56] References Cited

U.S. PATENT DOCUMENTS

| | | | |
|---|---|---|---|
| 2,211,275 | 8/1940 | Lachapelle . | |
| 3,189,935 | 6/1965 | Euga | 15/104.92 |
| 3,813,722 | 6/1974 | Sapochinik | 15/104.92 |
| 3,956,789 | 5/1976 | Shults et al. | 15/97 R |
| 4,252,454 | 2/1981 | Brenner | 401/37 |

FOREIGN PATENT DOCUMENTS 708949 5/1931 France .

*Primary Examiner*—Edward L. Roberts
*Attorney, Agent, or Firm*—W. H. Kamstra

[57] ABSTRACT

Apparatus (16) for cleaning or lubricating inaccessible pin arrays of an electrical interconnection backplane (10). A connector block (18) with contacts removed is mounted on the end of a dummy circuit board (17). The connector block (18) is slotted across the contact chambers (20), the slot (21) having an absorbent element (24) fitted therein. The element (24), which may be of a polyurethane foam, is saturated with a cleaning or lubricating agent. To clean or lubricate the pins (11), the dummy board (17) is fitted between the guide frames until the backplane pins (11) pierce the absorbent element (24), the latter being "selfhealing" when the appartus is withdrawn.

10 Claims, 2 Drawing Figures

FIG. 1
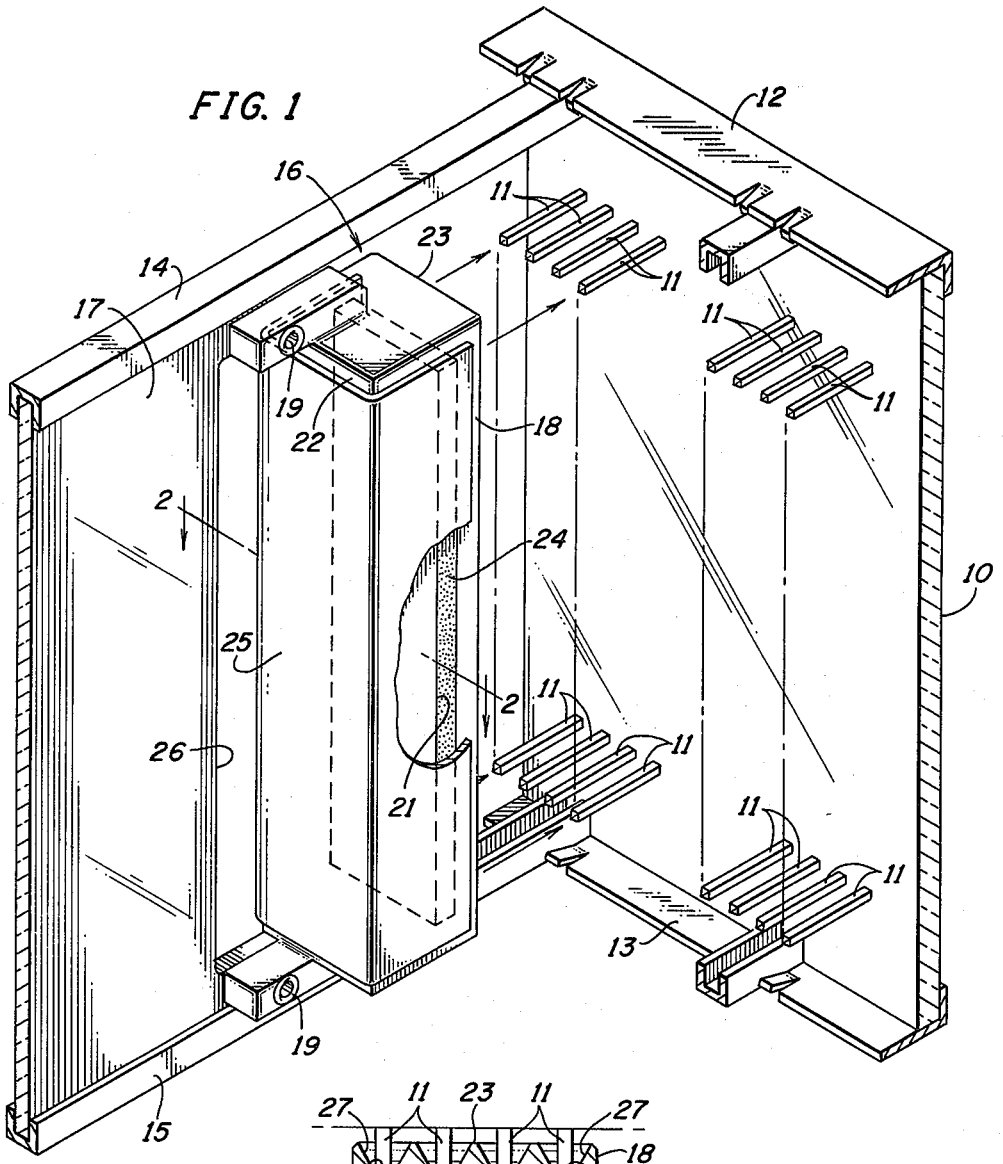
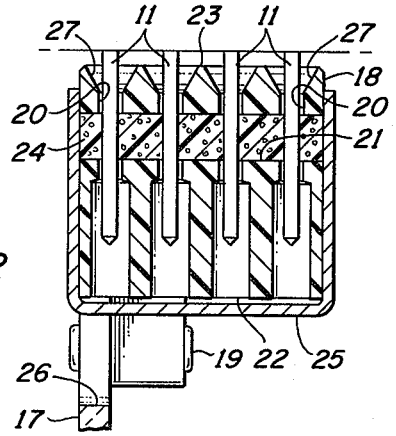
FIG. 2

ELECTRICAL TERMINAL PIN CONDITIONING APPARATUS

TECHNICAL FIELD

This invention relates to electrical interconnection assemblies and particularly to tools and devices for servicing terminal pins employed in such assemblies.

BACKGROUND OF THE INVENTION

Electrical interconnection assemblies in which printed wiring boards are mounted on a common backplane have long provided an advantageous means for assembling and mounting relatively large numbers of electrical components. Typically, the boards are fitted between guide frames extending from the backplane, the electrical connections from the board circuitry being extended through a female connector mounted on the board leading edge to an assigned backplane terminal pin field to which the connector is mated. Further electrical circuits may then be extended to wiring mounted on the backplane itself and to wiring connected to extensions of the terminal pins at the rear of the backplane as is also known. It will be appreciated that it is imperative for the reliable operation of the system in which the interconnection assembly is employed that positive and low resistive electrical connections between the connector contacts and the backplane terminal pins be achieved. This has, in the past, presented a problem, particularly in the field, where the backplane terminal pins are frequently affected by atmospheric contaminates such as sulphur, chlorine, particulate matter, and the like. Measures proposed for cleaning the pins such as removing a backplane assembly and dipping the unit in a solvent are time consuming and costly. The mating and remating of a board connector and the backplane pins to scrub the pins, as has been done, is at best make-shift and could lead to undue pin and contact wear. The care and conditioning of backplane terminal pins also calls for their occasional lubrication. This has in the past presented the problem of applying a lubricating agent in a connector contact at the point where needed, that is, on the contact blades where sliding engagement with a backplane terminal pin occurs. Inadequate lubrication of the opposing faces of the contact blades may also occasion undue pin wear. It is to the twin problems of the cleaning and the lubricating of backplane terminal pins that the apparatus of the invention is chiefly directed.

SUMMARY OF THE INVENTION

The objectives of the invention are realized in one illustrative embodiment thereof comprising a modified conventional connector end-mounted on a dummy circuit board. The connector is modified by removing its contacts and cutting a slot completely therethrough parallel to its forward and rear faces. A polyurethane foam or other absorbent element is inserted in the slot, which element may be saturated with a cleaning agent or a lubricant as determined by the particular conditioning operation to be performed. When so saturated, the dummy circuit board is fitted between the board guide frames until the backplane terminal pin array to be conditioned pierces the absorbent element of the modified connector. The dummy board is then withdrawn leaving the pins cleaned or lubricated. The absorbent element is self-healing after its piercing by the terminal pins to permit its immediate reuse for the conditioning of other pin arrays.

BRIEF DESCRIPTION OF THE DRAWING

The organization and operation of a terminal pin conditioning apparatus according to the principles of the invention will be better understood from a consideration of the detailed description of one illustrative embodiment thereof which follows when taken in conjunction with the accompanying drawing in which:

FIG. 1 depicts in perspective view a portion of a conventional interconnection backplane, the conditioning apparatus according to the invention being shown in place between backplane guide frames preparatory to its final mating with a backplane terminal pin array; and FIG. 2 is an enlarged section view of the conditioning apparatus of FIG. 1 taken along the line 2—2 in the direction indicated showing terminal pins piercing the connector absorbent element during an illustrative pin conditioning operation.

DETAILED DESCRIPTION

A portion of a typical backplane 10 and representative terminal pins 11 of a pair of pin arrays are shown in essential detail in the perspective view of FIG. 1. Backplane 10 is conventionally provided with frames 12 and 13 from which are extended guide frames 14 and 15 between which guide frames a printed wiring board is normally fitted, the end connector of the board making electrical connection with backplane pins 11 as is known. The terminal pin conditioning apparatus 16 according to the invention comprises a dummy board 17 dimensioned for a slidable fit between guide frames 14 and 15 after the functioning circuit board has been removed. The board 17 functions as a handle means to move the device along the guide means. A connector block 18 is mounted across the end and on one side of board 17 in any conventional manner such as by means of rivets 19. Typical connector block 18 is modified by removing its electrical contacts, leaving its contact chambers 20 open to the free admission of pins 11 (FIG. 2). Connector block 18 is further modified by a rectangular slot 21 formed therein parallel to its rear and forward faces 22 and 23 running just short of the connector block ends. Within slot 21 is fitted an absorbent element 24 formed of any suitable material such as, for example, polyurethane foam, adapted for holding a cleaning agent or lubricant. A cover 25, shown broken away in FIG. 1 to reveal details of connector block 18, is snap fitted over the block from the rear to retain absorbent element 24 in place. Dummy board 17 is formed to present a recess 26 across its end to permit sufficient withdrawal of cover 25 for access to slot 21 and its absorbent element 21. This access is initially required to insert an absorbent element 24 saturated with a cleaning agent or lubricant into slot 21 preparatory to a cleaning or lubricating operation. When so prepared, cover 25 is replaced over slot 21 and board 17 of conditioning apparatus 16 is fitted between the guide frames 14 and 15 identified with the terminal pin array to be cleaned or lubricated. Apparatus 16 is then moved forward between guide frames 14 and 15 until array pins 11 are fully inserted in connector block 18, the entry cones 27 of the block facilitating their entry. As connector block 18 is mated with a pin array, individual pins 11 pierce the saturated absorbent element 24 and are thus cleaned (or lubricated). Dummy board 17 may now be removed for immediate reuse in connection with another pin array. Perforations caused by the entry of pins 11 into element 24 are self-closing when a polyurethane foam and similar materials are used for element 24.

What has been described is considered to be only one specific, illustrative terminal pin conditioning apparatus according to the principles of the invention. Accordingly, it is to be understood that various and numerous other arrangements may be devised by one skilled in the art without departing from the spirit and scope of the invention as limited only by the accompanying claims.

What is claimed is:

1. Apparatus for conditioning the pins of a terminal pin array of an electrical backplane comprising a block having an array of apertures corresponding to said pin array, said block further having a slot formed at substantially right angles to the axes of said apertures, and an absorbent element fitted in said slot, said absorbent element being saturated by a fluid and being pierceable by said pins of said pin array.

2. Apparatus as claimed in claim 1 also comprising handle means affixed to said block for manually mating said apertures of said block and said terminal pin array.

3. Apparatus as claimed in claim 2 in which said handle means comprises a rectangular board means having said block mounted across one edge thereof, said board means being dimensioned to fit between guide frames of an electrical circuit board adapted for electrical connection with said pin array.

4. Apparatus as claimed in claims 1, 2, or 3 also comprising a cover means fitted about said block over said slot.

5. Apparatus as claimed in claim 4 in which said saturable element comprises a polyurethane foam.

6. Apparatus as claimed in claim 4 in which said fluid comprises a cleaning agent.

7. Apparatus as claimed in claim 4 in which said fluid comprises a lubricating agent.

8. Apparatus for conditioning the pins of a terminal pin array of an electrical interconnection backplane, said backplane having guide frames extending therefrom for receiving therebetween an electrical circuit board, said apparatus comprising a substantially rectangular mounting board dimensioned to fit between said guide frames, a substantially rectangular block mounted across one edge of said mounting board, said block having an array of apertures therein corresponding to said pin array, said block further having a slot formed therein at substantially right angles to the axes of said apertures, an absorbent element fitted in said slot, said absorbent element being saturable by a fluid and being pierceable by said pins of said pin array, and a cover fitted about said block over said slot for retaining said absorbent element.

9. Apparatus as claimed in claim 8 in which said fluid comprises a cleaning agent.

10. Apparatus as claimed in claim 8 in which said fluid comprises a lubricating agent.

* * * * *